United States Patent [19]

Kanto et al.

[11] Patent Number: 4,952,553

[45] Date of Patent: Aug. 28, 1990

[54] HEAT TRANSFER SHEET

[75] Inventors: Jumpei Kanto; Hitoshi Saito, both of Shinjuku, Japan

[73] Assignee: Dai Nippon Insatsu Kabushiki Kaisha, Japan

[21] Appl. No.: 304,040

[22] Filed: Jan. 31, 1989

[30] Foreign Application Priority Data

Feb. 2, 1988 [JP] Japan ..... 63-21227

[51] Int. Cl.[5] ..... B41M 5/035; B41M 5/26

[52] U.S. Cl. ..... 503/227; 8/471; 428/195; 428/913; 428/914

[58] Field of Search ..... 8/471; 428/913, 914, 428/195; 503/227

[56] References Cited

FOREIGN PATENT DOCUMENTS

| | | | |
|---|---|---|---|
| 0279467 | 8/1988 | European Pat. Off. | 503/227 |
| 62-220557 | 9/1987 | Japan | 8/636 |
| 2191498A | 12/1987 | United Kingdom | 8/636 |

*Primary Examiner*—Bruce H. Hess

*Attorney, Agent, or Firm*—Arnold, White & Durkee

[57] ABSTRACT

A heat transfer sheet, including a substrate sheet and a dye carrying layer formed on one surface of the substrate sheet. A dye included in the dye carrying layer is represented by the formula (I) shown below:

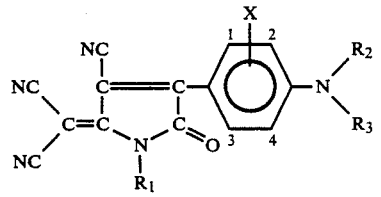

(I)

wherein $R_1$, $R_2$ and $R_3$ each represent a hydrogen atom, an alkyl, cycloalkyl, alkenyl, alkynyl or phenyl group which may have substituent, X represents a hydrogen atom, a halogen atom, an alkyl or alkoxy group, —NHCOR or —$NHSO_2$ R (R has ther same meaning as $R_1$).

4 Claims, No Drawings

HEAT TRANSFER SHEET

BACKGROUND OF THE INVENTION

This invention relates to a heat transfer sheet, capable of easily providing recorded images excellent in various fastnesses to image-receiving materials.

Heretofore, various heat transfer methods have been known and among them, there has been practiced a sublimation transfer method in which a sublimable dye is used as the recording agent, which is carried on a substrate sheet such as paper, etc. to provide a heat transfer sheet. The substrate sheet is superposed on an image-receiving material dyable with a sublimable dye such as a fabric made of polyester, etc., and a heat pattern is applied from the back surface of the heat transfer sheet, thereby migrating the sublimable dye to the image-receiving material.

In the above sublimation transfer method, in the sublimation printing method wherein the image-receiving material is, for example, a fabric made of polyester, etc., heat energy is imparted for a relatively long time, and thus, the image-receiving material itself is also heated with the heat energy imparted, whereby relatively good migration of the dye is accomplished.

However, with the progress of the recording method, when by the use of a thermal head, etc., fine letters, figures or photographic images are formed at high speed on, for example, polyester sheets or image-receiving materials having dye receiving layers provided on paper, heat energy utilized is required to be extremely short in time (i.e. second unit or less) and therefore, because the sublimable dye and the image-receiving material cannot be heated sufficiently, no image with sufficient density can be formed.

Accordingly, in order to respond to such high speed recording, a sublimable dye excellent in sublimability has been developed. However, a dye excellent in sublimability has generally a small molecular weight, and therefore the dye will migrate with lapse of time in the image-receiving material after transfer, or bleed out onto the surface, whereby such problems occur that the image formed elaborately is disturbed or becomes indistinct or the surrounding articles are contaminated.

For avoiding such problems, if a sublimable dye having relatively larger molecular weight is used, the sublimation rate is inferior in the high speed recording method as described above,, and hence no image with satisfactory density can be formed as described above.

Accordingly, in the heat transfer method by use of a sublimable dye, it has been strongly demanded under the present situation to develop a heat transfer sheet which can give sharp images with sufficient density, and which can provide the images formed with excellent various fastnesses by imparting heat energy for an extremely short period of time as mentioned above.

The present inventors have studied intensively in order to respond to the strong demand in this field of the art as described above, and have consequently found that, although in the sublimation printing method of the fabric made of polyester, etc., because of the surface of the fabric which was not smooth, the heat transfer sheet and the fabric which was the image-receiving material were not sufficiently contacted closely with each other. Therefore it has been required that the dye used should be sublimable or vaporizable (namely the property of being migratable through the space existing between the heat transfer sheet and the fabric). Applicants have also found in the case when a polyester sheet or converted paper, etc. having smooth surface is used as the image-receiving material, only sublimability or vaporizability of the dye is not the absolutely necessary condition because the heat transfer sheet and the image-receiving material can be sufficiently contacted closely with each other, but the property of the dye migratable through the interface of both the closly contacted by heat is also extremely important. Applicants have also found that such heat migratability through the interface is greatly influenced by the chemical structure of the dye, substituents or the positions thereof, and that even a dye having a high molecular weight to the extent which has been considered to be unavailable according to the common sense in the prior art has good heat migratability by selection of a dye having an appropriate molecular structure. By use of a heat transfer sheet having such dye carried thereon, it has been found that the dye used can be easily migrated to the image-receiving material to form a recorded image having high density and excellent various fastnesses, to accomplish the present invention.

SUMMARY OF THE INVENTION

More specifically, the present invention provides a heat transfer sheet, comprising a substrate sheet and a dye carrying layer formed on one surface of said substrate sheet, characterized in that a dye included in said dye carrying layer is represented by the formula (I) shown below:

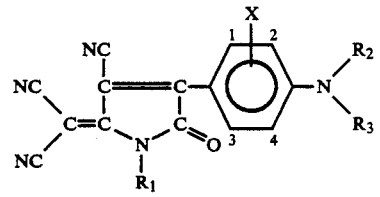

(I)

wherein $R_1$, $R_2$ and $R_3$ each represent hydrogen atom, an alkyl, cycloalkyl, alkenyl, alkynyl or phenyl group which may have substituent, X represents a hydrogen atom, a halogen atom, an alkyl or alkoxy group, —NHCOR or —$NHSO_2R$ (R has the same meaning as $R_1$).

The present inventors have continued detailed study, for various dyes, about adaptability as the dye for heat transfer sheet, and consequently found that only the dyes represented by the above formula (I) have excellent heating migratability even, when having relatively larger molecular weights. Further, these dyes exhibit excellent dyeability and color formability to image-receiving materials. Moreover, these dyes have extremely ideal properties as the dye for heat transfer sheet, without migratability (bleeding property) of the dye transferred in the image-receiving material being observed.

DETAILED DESCRIPTION OF THE INVENTION

Preferable dyes of the above formula (I) in the present invention are those wherein $R_1$ is hydrogen atom, a lower alkyl or alkenyl group $R_2$ and/or $R_3$ is $C_2$ to $C_{10}$ alkyl group, and at least one of $R_2$ and $R_3$ has a polar group such as hydroxy group or substituted hydroxy group, amino group or a substituted amino group, cyano group, etc., which were found to have the best results, namely excellent heating migratability, dyeability to image-receiving materials, heat resistance, color formability during transfer, and at the same time excellent migration resistance after transfer, etc.

Specific preferable examples of the dyes in the present invention are shown below. The following Table 1 shows the substituents X, $R_1$ and $R_2$ in the formula (I).

TABLE 1

| No. | $R_1$ | X | $R_2$ | $R_3$ |
|---|---|---|---|---|
| 1 | $C_4H_9$ | H | $C_4H_9$ | $(CH_2)_3ph$ |
| 2 | H | 1-$CH_3$ | $C_2H_5$ | $C_2H_4OH$ |
| 3 | $CH_3$ | H | $C_3H_7$ | $C_2H_4ph$ |
| 4 | H | 3-Cl | $C_2H_4OH$ | $C_2H_5$ |
| 5 | $C_2H_5$ | H | $C_2H_4OH$ | $C_2H_4OH$ |
| 6 | H | 1,4-di-$OCH_3$ | $CH_3$ | $CH_3$ |
| 7 | H | 1,3-di-$CH_3$ | $C_8H_{17}$ | $C_8H_{17}$ |
| 8 | iso$C_3H_7$ | H | $C_2H_5$ | $C_2H_4CN$ |
| 9 | H | H | $C_2H_5$ | $C_2H_4OCH_3$ |
| 10 | ph | 2-$C_2H_5$ | $C_2H_5$ | $C_2H_4OH$ |
| 11 | H | 2-$OC_2H_5$ | $C_2H_4OH$ | $C_2H_5$ |
| 12 | $CH_2ph$ | H | $C_2H_5$ | $C_2H_4NHCOCH_3$ |
| 13 | H | 3-$NHCOCH_3$ | $C_4H_9$ | $C_4H_9$ |
| 14 | H | H | $C_2H_5$ | $C_2H_4Oph$ |
| 15 | H | H | $C_2H_5$ | $C_2H_4NHSO_2CH_3$ |
| 16 | H | 3-$NHSO_2CH_3$ | $C_2H_5$ | $C_2H_4Oph$ |

The heat transfer sheet of the present invention is characterized by using a specific dye as described above, and other constitutions may be the same as those in the heat transfer sheet known in the art.

As the substrate sheet to be used in the constitution of the heat transfer sheet of the present invention containing the above dye, any material known in the art having heat resistance and strength to some extent may be available, including, for example, papers, various converted papers, polyester films, polystyrene films, polypropylene films, polysulfone films, polycarbonate films, Aramide films, polyvinyl alcohol films, cellophane, etc. having thicknesses of about 0.5 to 50 μm, preferably 3 to 10 μm, particularly preferably polyester films.

The dye carrying layer provided on the surface of the substrate sheet as described above is a layer having a dye of the above formula (I) carried with any desired binder resin.

Examples of the binder resin for carrying the above dye may include any of those known in the art, preferably cellulosic resins such as ethyl cellulose, hydroxyethyl cellulose, ethylhydroxyethyl cellulose, hydroxypropyl cellulose, methyl cellulose, cellulose acetate, cellulose acetate butyrate, etc.; vinyl resins such as polyvinyl alcohol, polyvinyl acetate, polyvinyl butyral, polyvinyl acetoacetal, polyvinylpyrrolidone, polyacrylamide, etc. Among them, polyvinyl butyral and polyvinyl acetal are particularly preferred with respect to heat resistance, migratability of the dye, etc.

The dye carrying layer of the heat transfer sheet of the present invention is formed basically of the above materials, but can otherwise include various additives similar to those known in the art, if necessary.

Such a dye carrying layer is formed preferably by adding the above dye, binder resin and other optional components into a suitable solvent to dissolve or disperse the respective components therein, thus preparing a coating solution or ink for formation of a carrying layer and coating and drying this on the above substrate sheet.

The carrying layer thus formed may have a thickness of about 0.2 to 5.0 μm preferably 0.4 to 2.0 μm, and the above dye in the carrying layer may preferably exist in an amount of 5 to 70% by weight based on the weight of the carrying layer, preferably 10 to 60% by weight.

The heat transfer sheet of the present invention as described above is sufficiently useful as such for heat transfer, but further a tack preventive layer, namely a mold release layer may be also provided on the surface of the dye carrying layer. By the provision of such a layer, tackiness between the heat transfer sheet and the image-receiving material during heat transfer can be prevented, and an image of further excellent density can be formed by use of further higher heat transfer temperature.

As a mold release layer, a layer formed by inorganic powder for tack preventive exhibits considerable effect, and further it can be formed by providing a mold release layer with a thickness of 0.01 to 5 μm, preferably 0.05 to 2 μm, from a resin having excellent mold release property such as silicone polymer, acrylic polymer or fluorinated polymer.

The inorganic powder or mold releasable polymer as described above can be also included within the dye carrying layer to exhibit sufficient effect.

Further, on the back surface of such a heat transfer sheet, a heat-resistant layer may be also provided for prevention of deleterious influences from the heat of a thermal head.

The image-receiving material to be used for forming an image by use of the heat transfer sheet as described above may be any material of which recording surface has dye receptivity for the above dye, and in the case of paper, metal, glass, synthetic resin, etc. having no dye receptivity, a dye receiving layer may be formed on at least one surface thereof.

Examples of the image-receiving material on which no dye receiving layer may be formed include fibers, fabrics, films, sheets, moldings, etc. comprising polyolefin resins such as polypropylene, etc.; halogenated polymers such as polyvinyl chloride, polyvinylidene chloride; vinyl polymers such as polyvinyl acetate, polyacrylate, etc; polyester resins such as polyethylene terephthalate, polybutylene terephthalate; polystyrene resins; polyamide resins; copolymer resins of olefins such as ethylene or propylene with other vinyl monomers; ionomers; cellulosic resins such as cellulose diacetate, etc.; polycarbonate; and others.

Particularly preferred are sheets or films comprising polyester or converted papers having polyester layer provided thereon. Also, even a non-dyeable image-receiving material such as paper, metal, glass or others can be made an image-receiving material by coating and drying a solution or dispersion of the dyeable resin as described above on its recording surface, or laminating those resin films thereon.

Further, even the above image-receiving material having dyeability may also have a dye receiving layer formed from a resin having further better dyeability on its surface similarly as in the case of papers as described above.

The dye receiving layer thus formed may be formed from either a single material or a plurality of materials, and further various additives may be added within the range which does not disturb the desired object, as a matter of course.

Such dye receiving layer may have any desired thickness, but generally a thickness of 5 to 50 μm. Such dye receiving layer may be preferably a continuous coating, but it can be also made an incontinuous coating by use of a resin emulsion or resin dispersion.

Such image-receiving material can be used sufficiently as such basically in the form as described above, but inorganic powder for tack prevention can be also included in the above image-receiving material, and by doing so, tackiness between the heat transfer sheet and the image-receiving material can be prevented even when the temperaure during heat transfer may be elevated higher to effect further excellent heat transfer. Preferably, fine powdery silica may be used.

Also, in place of the inorganic powder as described above such as silica, or in combination therewith, a resin as described above of good mold releasability may be added. Preferred mold releasable polymers may include cured products of silicone compounds, for example, cured product comprising epoxy-modified silicone oil and amino-modified silicone oil. Such mold releasable agent may preferably comprise about 0.5 to 30% by weight based on the weight of the dye receiving layer.

The image-receiving layer used may have the inorganic powder as described above attached on the surface of the dye receiving layer to enhance the tack preventing effect, and may also have a layer comprising a mold release agent having excellent mold releasability as described above provided thereon.

Such mold release layer can exhibit sufficient effect with a thickness of about 0.01 to 5 μm, thereby improving further dye receptivity while preventing tackiness between the heat transfer sheet and the dye receiving layer.

As the means for imparting heat energy to be used during heat transfer by use of the heat transfer sheet of the present invention and the image-receiving material as described above, any of imparting means known in the art can be used. For example, by use of a recording device such as a thermal printer (e.g., Video Printer VY-100, produced by Hitachi K.K., Japan), by controlling the recording time to impart heat energy of about 5 to 100 mJ/mm$^2$, the desired object can be sufficiently accomplished.

According to the present invention as described above, as already described partially, the dye of the above formula (I) to be used in constituting the heat transfer sheet of the present invention, because of having a specific structure and substituents at specific positions in spite of having a remarkably higher molecular weight as compared with the sublimable dyes (having molecular weights of about 150 to 250) used in the heat transfer sheet of the prior art, exhibits excellent heating migratability, dyeability and color formability to image-receiving materials, and also will be free from migration in the image-receiving material or bleed-out on the surface after transfer.

Accordingly, the image formed by use of the heat transfer sheet of the present invention has excellent fastness, particularly migration resistance and contamination resistance, and therefore sharpness of the image formed will not be impaired or other articles will not be contaminated when stored for a long term, thus solving various problems of the prior art.

The present invention is described in more detail by referring to Examples and Comparative Examples, in which parts and % are based on weight, unless otherwise particularly noted.

EXAMPLE 1

An ink composition for formation of dye carrying layer with a composition shown below was prepared, and coated on a 4.5 μm thick polyethylene terephthalate film applied with the heat-resistant treatment on the back surface to a coated amount on drying of 1.0 g/m$^2$, followed by drying, to obtain a heat transfer sheet of the present invention.

| | |
|---|---|
| Dye in the above Table 1 | 3 parts |
| Polyvinyl acetoacetal resin | 4.5 parts |
| Methyl ethyl ketone | 46.25 parts |
| Toluene | 46.25 parts |

Next, by use of a synthetic paper (Yupo FPG#150, produced by Oji Yuka, Japan) as the substrate sheet, a coating solution with a composition shown below was coated on one surface thereof at a ratio of 10.0 g.m/$^2$ on drying and dried at 100° C. for 30 minutes to obtain an image-receiving material.

| | |
|---|---|
| Polyester resin (Vilon 200, produced by Toyobo, Japan) | 11.5 parts |
| Vinyl chloride-vinyl acetate copolymer (VYHH, produced by UCC) | 5.0 parts |
| Amino-modified silicone (KF-393, produced by Shinetsu Kagaku Kogyo, Japan) | 1.2 parts |
| Epoxy-modified silicone (X-22-343, produced by Shinetsu Kagaku Kogyo, Japan) | 1.2 parts |
| Methyl ethyl ketone/toluene/cyclohexanone (weight ratio 4:4:2) | 102.0 parts |

The heat transfer sheet of the present invention as described above and the above image-receiving material were superposed on one another with the dye carrying layer and the dye receiving opposed to each other, and recording was effected with a thermal head from the back surface of the heat transfer sheet under the conditions of a heat application voltage of 10V, a printing time of 4.0 msec. to obtain the result shown below in Table 2.

COMPARATIVE EXAMPLE

Example 1 was repeated except for using the dyes shown below in Table 3 as the dye in comparative Example to obtain the results shown below in Table 3. However, the ink composition for formation of the dye carrying layer was made to have the following composition.

| | |
|---|---|
| Dye shown below in Table 3 | 3 parts |
| Polyvinyl acetoacetal resin | 4.5 parts |
| Methyl ethyl ketone | 46.25 parts |
| Toluene | 46.25 parts |

TABLE 2

| Dye | Color formed density | Fastness | Tone | Molecular weight |
|---|---|---|---|---|
| 1 | 1.73 | ◎ | yellowish blue | 491 |
| 2 | 2.20 | ◎ | yellowish blue | 347 |
| 3 | 1.95 | ◎ | yellowish blue | 421 |
| 4 | 2.16 | ◎ | yellowish blue | 367.5 |
| 5 | 2.13 | ◎ | yellowish blue | 377 |
| 6 | 2.21 | ◎ | yellowish blue | 349 |
| 7 | 1.56 | ◎ | yellowish blue | 513 |

TABLE 2-continued

| Dye | Color formed density | Fastness | Tone | Molecular weight |
|---|---|---|---|---|
| 8 | 2.04 | ◎ | yellowish blue | 384 |
| 9 | 2.17 | ◎ | yellowish blue | 347 |
| 10 | 1.89 | ◎ | yellowish blue | 437 |
| 11 | 2.11 | ◎ | yellowish blue | 377 |
| 12 | 1.82 | ◎ | yellowish blue | 464 |
| 13 | 1.91 | ◎ | yellowish blue | 430 |
| 14 | 1.99 | ◎ | yellowish blue | 409 |
| 15 | 1.97 | ◎ | yellowish blue | 410.1 |
| 16 | 1.66 | ◎ | yellowish blue | 502.1 |

The dyes in the above Table were shown by the numerals in the above Table 1.

TABLE 3

| Dye | Color formed density | Fastness | Tone |
|---|---|---|---|
| 1 | 0.99 | x | Blue |
| 2 | 1.16 | Δ | Blue |
| 3 | 2.07 | x | Blue |
| 4 | 1.12 | Δ | Blue |
| 5 | 1.02 | x | Violet |

The dyes in the above Table are as shown below.

1: C.I. Disperse Blue 14
2: C.I. Disperse Blue 134
3: C.I. Solvent Blue 63
4: C.I. Disperse Blue 26
5: C.I. Disperse Violet 4

The color formed density in the above Tables 2 and 3 is the value measured by Densitometer RD-918 produced by Macbeth Co., U.S.A.

Fastness was measured by leaving the recorded image for a long time in an atmosphere of 50° C., and represented as ◎ when sharpness of the image did not change and rubbing of the surface with a white paper did not give coloration of the white paper, as ○ when sharpness was slightly lost and the white paper was slightly colored, as Δ when sharpness was lost and the white paper was colored and as x when image became indistinct and the white paper was remarkably colored.

What is claimed is:

1. A heat transfer sheet, comprising a substrate sheet having opposed surfaces and a dye carrying layer formed on one of the opposed surfaces of said substrate sheet, said dye carrying layer comprising a binder and a dye represented by the formula (I) shown below:

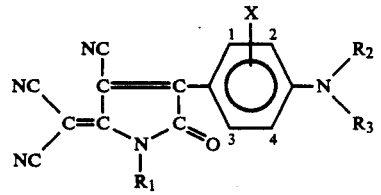

(I)

wherein $R_1$, $R_2$ and $R_3$ each represent a hydrogen atom, a substituted or unsubstituted alkyl, cycloalkyl, alkenyl, alkynyl or phenyl group, and X represents a hydrogen atom, a halogen atom, an alkyl or alkoxy group, —NHCOR or —$NHSO_2R$, R having the same meaning as $R_1$.

2. A heat transfer sheet according to claim 1, wherein a mold release layer is provided on the surface of said dye carrying layer.

3. A heat transfer sheet according to claim 1, wherein a heat-resistant layer is provided on the other of the opposed surfaces of said substrate sheet.

4. A heat transfer sheet according to claim 1, wherein said dye carrying layer contains a mold release agent.

* * * * *